US008267101B2

(12) United States Patent
Beard et al.

(10) Patent No.: US 8,267,101 B2
(45) Date of Patent: Sep. 18, 2012

(54) FRUIT BIN CLEANING METHOD AND APPARATUS

(75) Inventors: Thomas E Beard, Healdsburg, CA (US); Edwin L Barr, Petaluma, CA (US)

(73) Assignee: Echo Bravo LLC, Santa Rosa, CA (US)

( * ) Notice: Subject to any disclaimer, the term of this patent is extended or adjusted under 35 U.S.C. 154(b) by 0 days.

(21) Appl. No.: 13/218,781

(22) Filed: Aug. 26, 2011

(65) Prior Publication Data

US 2012/0048301 A1 Mar. 1, 2012

Related U.S. Application Data

(60) Provisional application No. 61/378,768, filed on Aug. 31, 2010, provisional application No. 61/449,251, filed on Mar. 4, 2011.

(51) Int. Cl.
*B08B 9/08* (2006.01)
*B08B 9/30* (2006.01)

(52) U.S. Cl. ..... 134/129

(58) Field of Classification Search ..... 134/129
See application file for complete search history.

(56) References Cited

FOREIGN PATENT DOCUMENTS

| | | | |
|---|---|---|---|
| EP | 1803507 A2 | * | 7/2007 |
| GB | 2003840 A | * | 3/1979 |
| JP | 06079249 A | * | 3/1994 |
| WO | WO03/002276 A1 | * | 1/2003 |

OTHER PUBLICATIONS

English Machine translation of JP6-79249.*

* cited by examiner

*Primary Examiner* — Michael Barr
*Assistant Examiner* — Jason Riggleman
(74) *Attorney, Agent, or Firm* — Edward S. Sherman

(57) ABSTRACT

An automated process for cleaning fruit bins, and particularly grape bins, deploys a conveyer system in which bins are simultaneously rinsed on the inside and outside in an inverted position. Two rinse cycles are rapidly completed with the conveyance of the inverted bins through a wash station. The wash station deploys a pivoting V-shaped spray rod inside the bin, below the conveyor track, while the outside is rinsed by a second surrounding inverted V-shaped spray bar that moves transverse to conveyor direction will the bin is stationary inside the wash station. A pivoting L-shaped arm with an integrated conveyor track move the bins on or off the central conveyor, while flipping them 90 degrees. Two such conveyors return the bins to an upright position for use and stacking. The water from a first rinse is optionally screened and treated before its use to rinse subsequent bins.

19 Claims, 14 Drawing Sheets

FIG. 3A
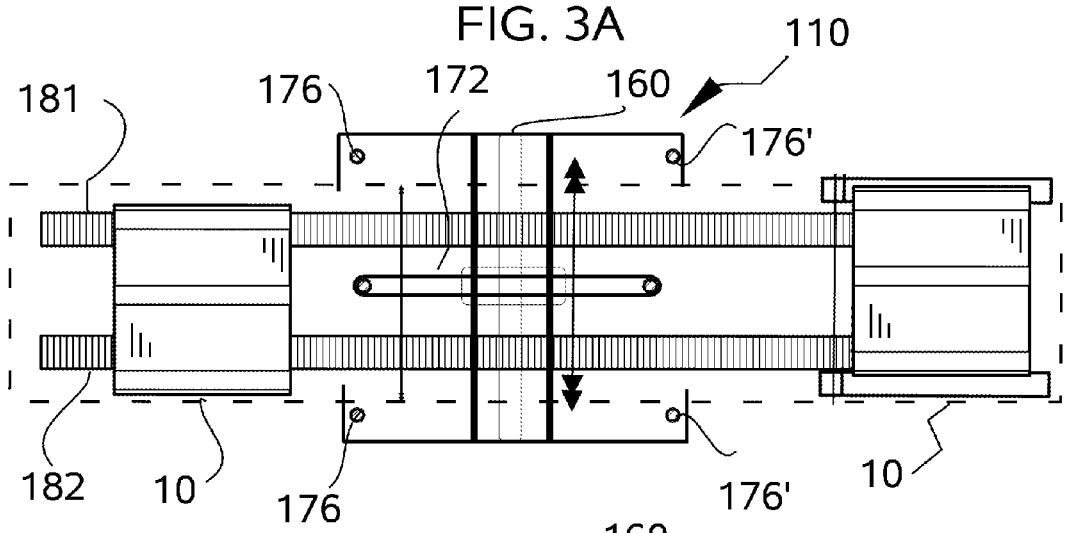
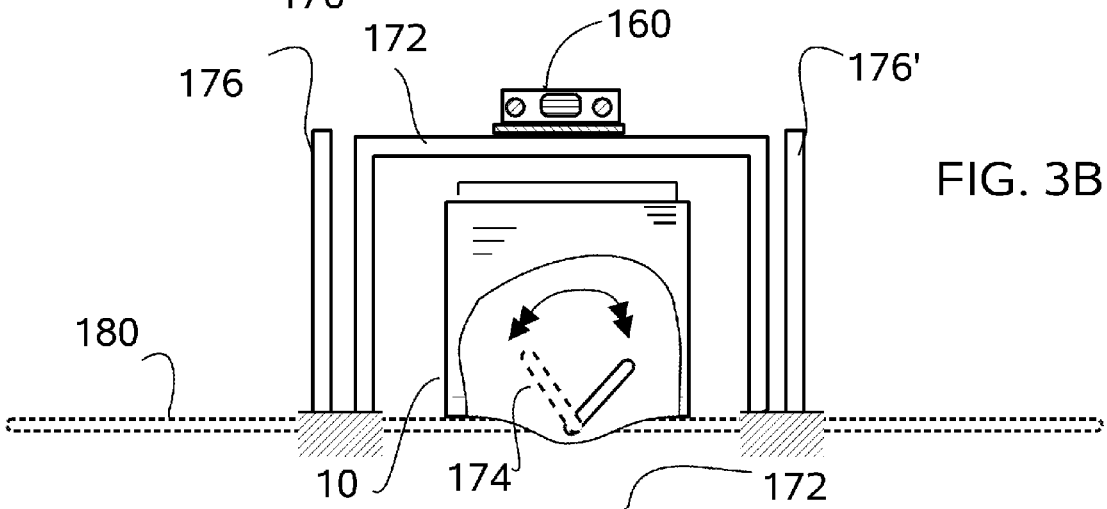
FIG. 3B
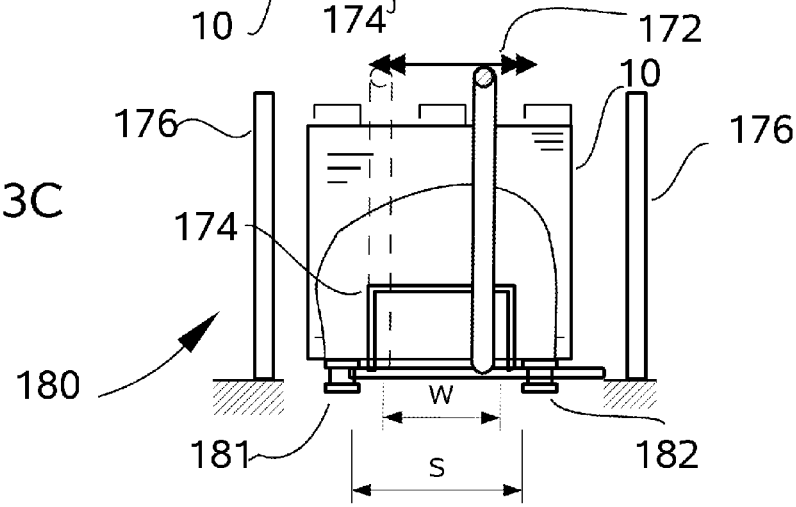
FIG. 3C 501
503

501
10
510

502
503
510
502

503
524
523
526'
527
526
525

10
522
520
521
581
526
582
523
524

FRUIT BIN CLEANING METHOD AND APPARATUS

CROSS REFERENCE TO RELATED APPLICATIONS

The present application claims the benefit of priority to the US Provisional patent application of the same title, which was filed on Aug. 31, 2010, and having application Ser. No. 61/378,768, which is incorporated herein by reference.

The present application also claims the benefit of priority to the US Provisional patent application of the same title, which was filed on Mar. 4, 2011, and having application Ser. No. 61/449,251, which is incorporated herein by reference

BACKGROUND OF INVENTION

The present invention relates to a method and apparatus for cleaning large fruit and grape picking bins with high efficiency.

Wineries receive grapes in generally square or rectangular half ton or ton capacity picking bins. While only grapes and the juice that inherently leaks from these grapes, should enter the bins, some grapes and juice as well as field debris (leaves, twig and material other than grapes) tends to remain in the bins after dumping to remove bulk of the harvested grapes, at least in part because grape juice is inherently sticky from the high sugar content, and becomes even stickier as water evaporates. Hence, grape and other fruit picking bins will become more contaminated over time if not thoroughly sanitized, as residual grape juice just below the rim readily evaporates leaving a sticky concentrated residue that will attracts insects, that are can be vectors for undesirable spoilage bacteria, and can also harbor wild yeasts. While such yeast and bacteria are not a problem in small quantities from the field, they can rapidly multiply to levels that are more difficult to control if they have the opportunity to do so if the grape bins are not promptly cleaned.

Thus, it is good harvest practice to clean the bins before refilling with freshly picked grapes. Hence, bins are preferably returned to the field, that is the same or different vineyard for repeated use in a clean condition, as well as cleaned before an initial use at the beginning of the harvest season.

As the bins may be hauled a long distance from the field to the winery on trucks, it is desirable to also replace the clean and empty bins as quickly as they are emptied, so that the delivery truck can return the same bins to the vineyard for re-filling without delay.

Accordingly, there is a need to rapidly clean fruit bins, and particularly grape bins, after they are emptied.

There is a further need that the cleaning be complete and thorough, as well as kill any residual yeast and bacteria on the surface of the bins.

As water is the primary cleaning agent, it is highly desirable to be as efficient as possible in the use of such water, as it is a major expense for wineries, in particular in the Western United States and in regions with "Mediterranean" climates that do not receive significant summer precipitation to replenish aquifers and water reservoirs. When grape and other fruit juice partially evaporates it can only be removed by scrubbing as well as the mechanical action of high velocity water jets. Scrubbing is difficult to automate, and also consumes rinse water. As high velocity jets consume large quantities of water there is a great need to reduce this use to a minimum.

Prior methods of automated grape bin cleaning methods are known, but do not keep up with the rate a truck can empty grape bins at an efficient crush pad.

It is therefore a first object of the present invention to provide a means to rapidly clean grape bins, that is highly effective and hygienic, yet does not waste significant quantities of water, and to do so rapidly with a high level of automation.

It is therefore a first object of the present invention to provide a means to clean grape bins that is highly effective and hygienic.

It is another object of the present invention to provide a means to rapidly clean grape bins according to the first object that does not waste significant quantities of water.

It is a still further object of the present invention to provide a means to rapidly clean grape bins, that is highly effective and hygienic, does not waste significant quantities of water, and to do so rapidly with a high level of automation.

SUMMARY OF INVENTION

In the present invention, the above and other object is achieved by process for washing grape bins comprising the steps of providing a first upright dirty grape bin, providing a washing station having a means to spray water and a means to collect and filter particle form the collected water, inverting the grape bin, disposing the inverting the grape bin in the washing station, providing a first spray of water to at least one of the inside and outside of the inverted grape bin, collecting the water after it drains off of the inverted grape bin and passes through the particle filter, providing a second spray of the water to at least one of the inside and outside of the inverted grape bin after said step of providing a first spray, wherein the water used in the first spray is from the collected water and the water used in the second spray is from a purer source of water than the collected water.

A second aspect of the invention is characterized by an apparatus and process for washing fruit bins that simultaneously rinses the 4 inside walls and the top and opposing sides while an inverted bin is stationary, wherein the front and back sides are rinsed as the bin is transported in and out of the stationary position used to wash the inside and top.

A third aspect of the invention is characterized by an apparatus and process for washing fruit bins wherein each fruit bin is inverted to the inverted position by two sequential rotations of about 90 degrees, each 90 degree rotation occurring in an L-shaped pivoting arm.

A fourth aspect of the invention is characterized by an apparatus and process for washing fruit bins wherein the fruit bin is transported from the first L-shaped pivoting arm to the second L-shaped pivoting upon being rotated 90 degrees by the first L-shaped pivot arm.

The above and other objects, effects, features, and advantages of the present invention will become more apparent from the following description of the embodiments thereof taken in conjunction with the accompanying drawings.

BRIEF DESCRIPTION OF THE DRAWINGS

FIG. 3A is a plan view of a washing station and conveyor system.

FIG. 3B is a side elevation of the washing station and conveyor system of FIG. 3A.

FIG. 3C is a front elevation of the washing station and conveyor system of FIGS. 3A and 3B.

FIGS. 7A and 7B are front and side elevations views respectively of a first embodiment of an L-shaped pivoting arm deployed in FIGS. 5, 6A and 6B, whereas FIG. 7C is a top plan view therof.

FIGS. 8A and 8B are plan and side elevation views respectively the second embodiment of an L-shaped pivoting arm deployed in FIGS. 5, 6A and 6B.

FIG. 9A is a perspective view of a portion of the conveyor system of FIG. 5 showing the cooperative operation of the first and second embodiments of the L-shaped pivoting arm, whereas FIG. 9B is a schematic elevation view at a smaller scale showing the orientation of the bin as received in the first L-shaped pivoting arm from the washing station.

FIG. 10A is a perspective view showing the subsequent stage in the movement of the L-shaped pivoting arm for rotating the bin 90 degrees from the inverted orientation in FIG. 9B, whereas

FIG. 11A is a perspective view showing resulting of completing the prior stage in the movement of the L-shaped pivoting arm for rotating the bin 90 degrees from the inverted orientation in FIG. 9B, whereas

FIG. 12A is a perspective view showing the subsequent stage in the movement of the L-shaped pivoting arm for rotating the bin 90 degrees from the inverted orientation in FIG. 9B, whereas

FIG. 13 is a perspective view showing resulting of completing the prior stage in the movement of the L-shaped pivoting arm for rotating the bin 90 degrees from the inverted orientation in FIG. 9B, whereas FIG. 10B is a schematic elevation view at a smaller scale showing the orientation of the bin upon completing this stage.

FIG. 14 is a perspective view showing the subsequent stage in the movement of the L-shaped pivoting arm for rotating the bin 90 degrees from the inverted orientation in FIG. 9B, whereas

DETAILED DESCRIPTION

Figure 1:
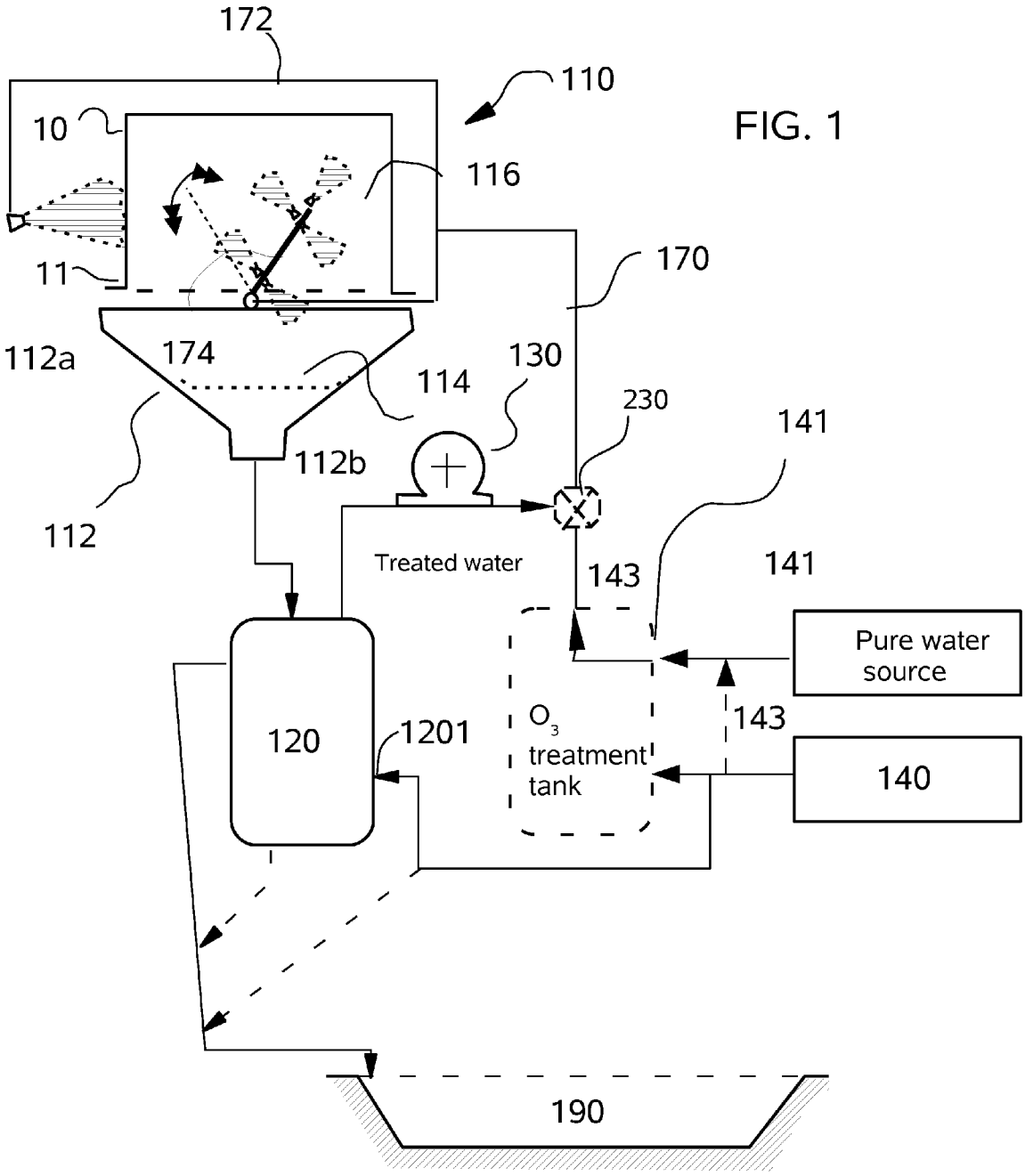
FIG. 1 is a schematic diagram illustrating the primary components of the inventive system, with the wash station shown in a side elevation view along the bin transport direction.

Referring to FIGS. 1 through 15, wherein like reference numerals refer to like components in the various views, there is illustrated therein a new and improved Fruit and Grape Bin Cleaning Method and Apparatus, generally denominated 100 herein.

In accordance with the present invention the system includes a wash station 110 having a funnel 112 disposed at the bottom for collecting water that drains off bins 10 as they are washed in an inverted state. Preferably, the bins or tanks 10 disposed in an inverted orientation in the wash station 110 are supported by a rack or a conveyor system 180 or frame on its rim 11. The funnel 112 has an upper rim 112*a* and terminates at the bottom end with orifice 112*b*. It should be appreciated that a wash station 110 will generally have at least one of an integrated side wall to catch overspray and spatter, or a separate external screen. Hence it is desirable, but not essential, that such integrated wall or separate external screen also drain to rim 112*a* of funnel 112. As grape picking bins, and other fruit picking bins, to which the invention is also applicable to, usually have a 4×4 ft. base, and are usually 2 or 4 ft in height, the dimension of the funnel rim 112*a* should be larger than 4×4 ft.

A screen 114 is disposed between the upper rim 112*a* and the orifice 112*b* of the funnel 112. A water storage tank 120 is in fluid communication to receive effluent from funnel orifice 112*b*. A pump 130 is configured to remove water from the storage tank 120 and transfer it under pressure via internal manifold 174 and exterior manifolds 172 and 176 to spray nozzles 116 where it emerges as a high velocity jet of water to clean bins 10. Further, an ozone source or generator 140 provides ozone gas to at least one portal 141 of a water source that is in fluid communication with the nozzles 116.

Generally, water from storage tank 120 is pumped to one or more spray nozzles 116 that surround or traverse the inside or outside of the inverted tank or bin 10. These preferably high velocity water jets or sprays first wash grosser debris and grape residue off of tank 10 which flows downward to drain to funnel 112. The screen 114 disposed in funnel 112 to capture solid matter so that generally particulate free rinse water flows back to tank 120. Thus, this first rinse step, as it uses drain water that accumulates in tank 120, is intended primarily to remove the solid and dried or syrupy grape juice residues.

In the next step, clean water, such as from source 141 is used in a final rinse. In order to insure that the final rinse also kills if not totally removes yeast and bacteria, the final rinse water is optionally ozonated either in-line from ozone source 140 via conduit or line 143. The system 100 may deploy a single pump, or multiple pumps depending on the inherent pressure of the water used in the rinse stage, or the need to achieve very high pressure in the initial knock down or debris removal stage.

Optionally, the water storage tank 120 is also ozonated to insure it does not harbor yeast and bacteria. The quantity of water from the repeated first and final rinses of bins will eventually fill tank 120, which is periodically drained. Usually such water, even if ozonated is considered waste, so it must be disposed of in a treatment pond 190. Deploying either the continuous ozonation in tank 120 or subsequent ozonation before emptying to the pond 190 reduces the biological oxygen demand (BOD) in the pond. Any subsequent ozonation optionally takes place in drain line that leads from tank 120 to wastewater pond 190

More preferably, the tank or bin 10 is rinsed on the outside via the spray nozzles 116 connected to an exterior manifold 172 and internally with spray nozzles connected to an interior manifold 174. Both the exterior manifold 172 and the interior manifold 174, are optionally connected to receive water at valve 230 via a common line or pipe 170.

Figure 2:
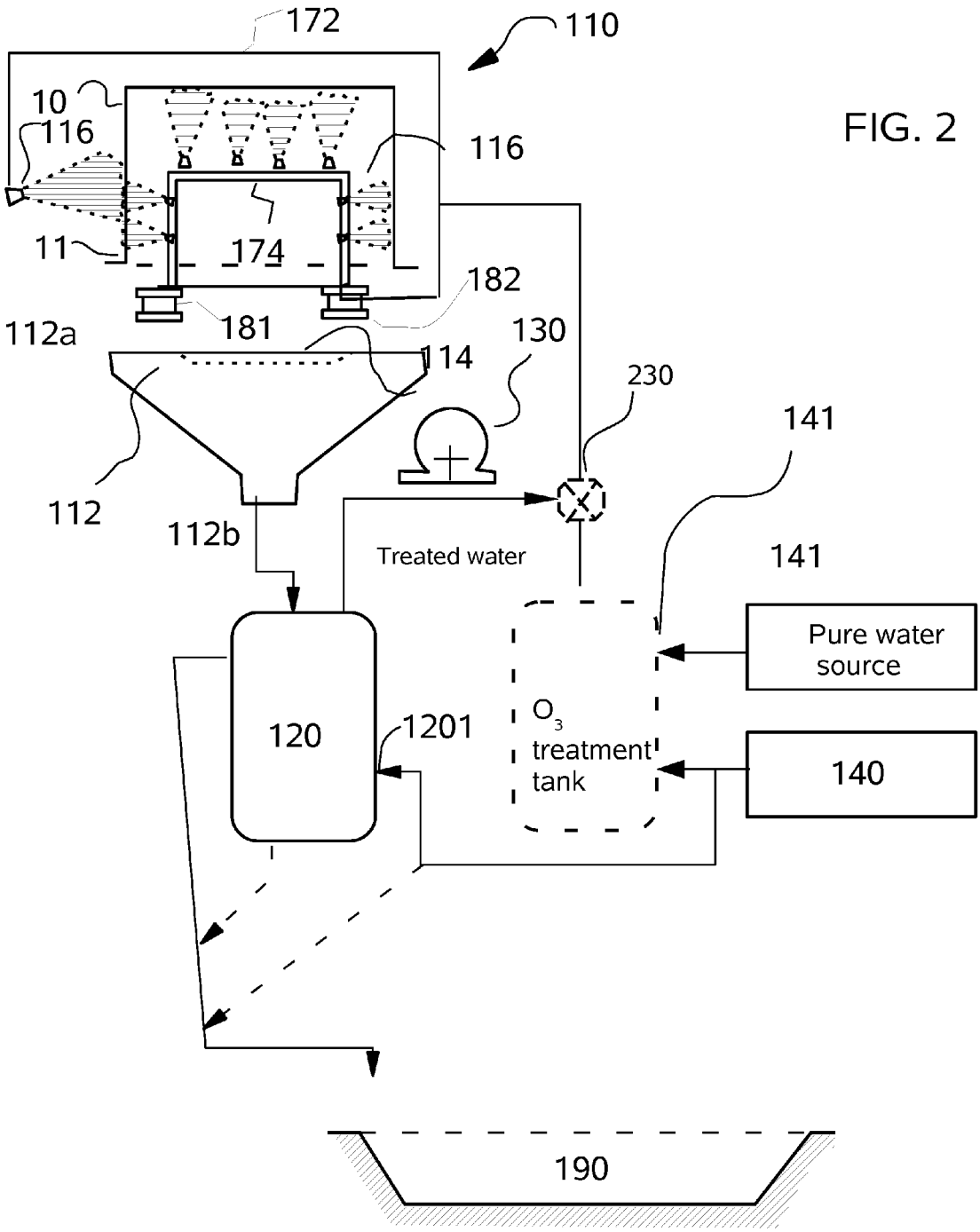
FIG. 2 is a schematic diagram illustrating the primary components of the inventive system, with the wash station shown in a front elevation view transverse to the bin transport direction.
Figure 4:
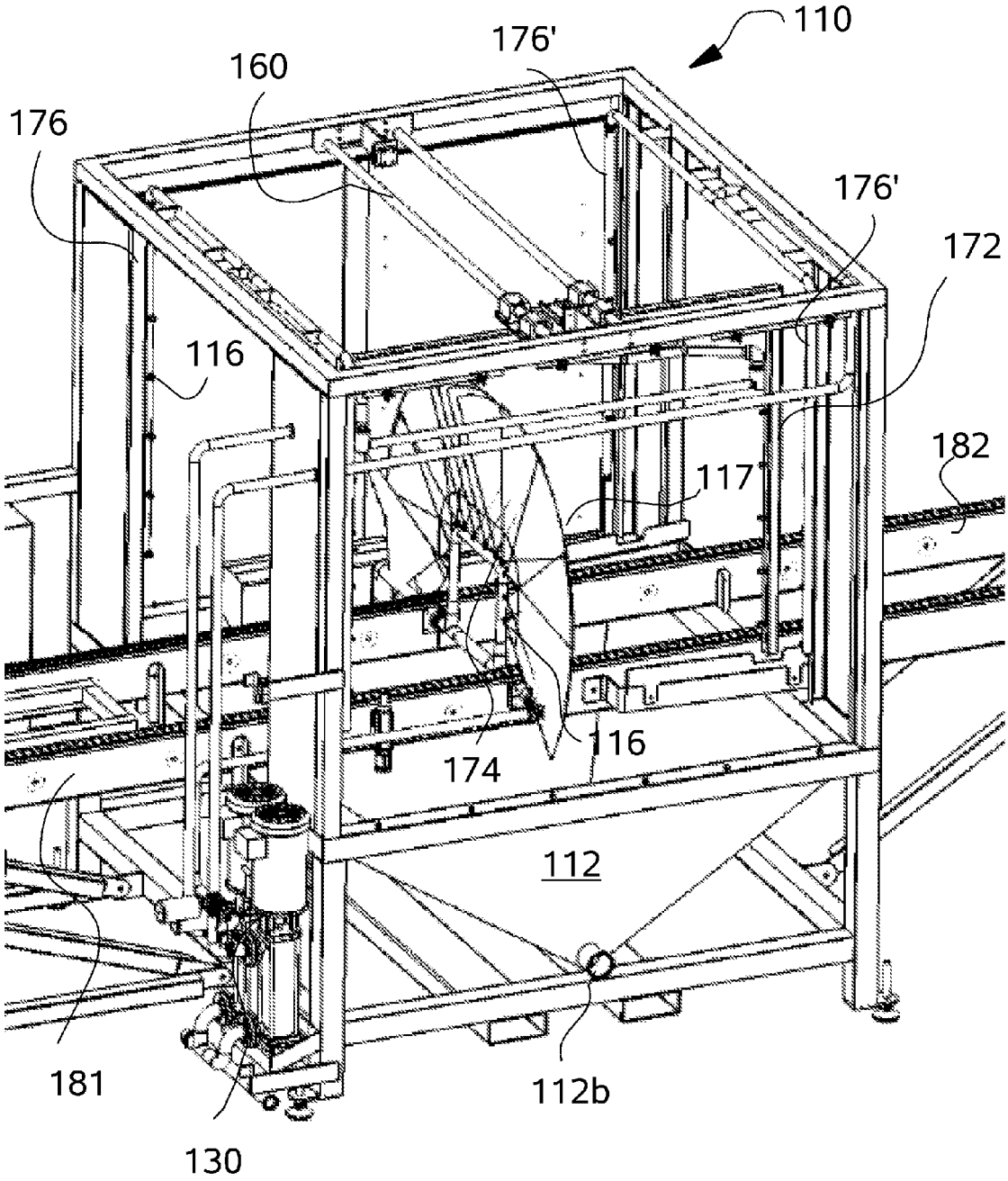
FIG. 4 is a perspective view of a wash station portion of the system omitting the bin to show the interior spray pattern.

The interior manifold 174, as shown in FIG. 2, is preferably an inverted U-shaped bar or pipe, of which the 3 sides of the U define a primary reference plane thereof. Rinse or spray water preferably enters the manifold 174 from the terminal arms that extend from the middle portion of the U-shape to minimize a potential difference in water pressure and flow rate between the spray nozzles 116 distributed on the interior manifold 172. The spray nozzles 116 are preferably selected and oriented such that the water spray there from fans outward substantially in this primary reference plane so that the collection of spray nozzles provides a substantially planar spray pattern that extends outward from the perimeter of the U-shape. Alternatively the interior manifold 174 can also be in the shape of a "D" rotated 90 degrees counter clockwise, but with the spray nozzles 116 disposed on the rounded upward facing part of the "D". In this configuration, water can be feed to the curved part of the D from either the center of the flat side, or the opposing terminals of the curved part of the "D", or just one side of the downward disposed flat portion to provide for a uniformity of water pressure and flow rate from the spray nozzles 116.

This resulting water spray pattern 117 (FIG. 4) is not only effective in reaching all portion of the interior tank surface, but by sweeping over the surface in oscillatory fashion, is very efficient at providing an energetic stream that dislodges partially adhered particulate matter and concentrated sticky grape juices, yet is highly efficient at doing so with a relatively small quantity of water per bin that is washed. The interior manifold 174, as shown in FIG. 2, is also configured to be disposed between 2 tracks 181 and 182 that together form a conveyor system 180 for transporting the bins 10 into the wash station 110. Since the width of the interior manifold, W (defined by the length of the bottom portion of the U shape) is less than the separation distance, S, between tracks 181 and 182, the interior manifold 174 can rotate downward below the common plane of these tracks so that bins 10 can be transported in and out of the wash station 110 by the conveyor system 180.

In a more preferred embodiment, As shown in FIG. 3B, the exterior manifold 172 is also preferably an inverted U-shape, but has nozzles 116 that are inward facing from the side, and downward facing from the top. The Inverted U profile of manifold 172 is dimensioned to straddle over bins 10 after they are transported into the washing station 110. Such an exterior manifold 172 can be engaged and transported by an overhead track or rail system 160 to be driven over the bin 10 in the transverse direction with respect to the transport direction of the bins 10 on conveyor 180. Thus, the front and back of the bins are washed by the water emitted from the laterally directed nozzles on the vertical portions of manifold 172, while the top of the bin is rinsed by the downward facing nozzles on horizontal portion of manifold 172. Preferably, water is feed from the terminal end of the side or vertical arms of the "U" to provide a more uniform flow rate and water pressure at each of the nozzles 116.

Furthermore, it is also preferable that the system 100 also provide 2 pairs of vertically oriented spray bars 176 and 176', each having a vertical sequence of nozzle 116 just inside the entrance and exit portal of the wash station 110 so as to wash the exterior sides of bin 10 that are disposed in a plane that is aligned with the transport direction on conveyor 180. The first set of spray bar pairs 176 provide a knock down spray as the bin is being transported into the wash station 110, while the second pair 176' provide a final clean up rinse as the bin 10 is being transported into the wash station 110 by conveyor 180.

In contrast, preferably the interior and exterior manifolds sequentially provide both the first or knock down spray, the water from which is directed to tank 120, and then the final rinse while the bin 10 is stationary in the wash station 110. The ozonated water from tank 120 can be used for the initial rise of bins 10 on the sides via spray bar pair 176.

It should be appreciated that the ozonation of the collected knock down spray and/or rinse water from funnel 112 can occur in tank 120, as well as when or after tank 120 drains to the treatment pond 190.

It should be appreciated that additional screening filters than screen 140 may be placed anywhere in the flow of water from drain 112*b* to nozzles 116 to remove debris that would clog the nozzles or otherwise interfere with efficient operation. The preferred placement and screening capacity of such additional screening filters is likely to depend on the throughput and the nozzle apertures, as well as the rate at which debris settle in tank 120, as rinse water is preferably drawn from the top of tank 120. Accordingly, screen 140 may in fact be a series or collection of screens.

In a more preferred aspect of the present invention, the bins 10 are rotated to and from the inverted position in the washing station by a plurality of L-shaped pivoting arms 500. A non-limiting example of the use of such pivoting arms 500 with a conveyor system is illustrated in the plan view of FIG. 5, in which the central portion 180 provides the washing station 110 described above. However, bins 10 are delivered to conveyor 180 by an entry conveyor 180' and removed from conveyor 180 after washing on the exit conveyor 5180'. While this embodiment shows the combination of conveyers 18', 180 and 5180' deployed in a U-shape, the L-shaped pivoting arms, which are described in further detail below, can be used with the central conveyor portion 180 only, provided the bins 10 are at least turned on their side when delivered thereto for washing.

Each L shaped pivoting arm 500 (also designated as 510, 520 and 530 in the alternative embodiments that follow) has a vertical support section 501 and a horizontal support section 502 attached thereto substantially at a right or 90 degree angle, with an axle 503 or similar rotary means provided at the junction of these supports sections. It should be appreciated that the terms horizontal and vertical are relative, as they refer to the orientation of the orthogonally disposed arms in a nominal reference rotation angle of axle 503. Thus, as the pivot arm rotates about axle 503 to rotate the bin 10 by 90 degrees each arm will alternate between the vertical to horizontal orientations.

Figure 5:
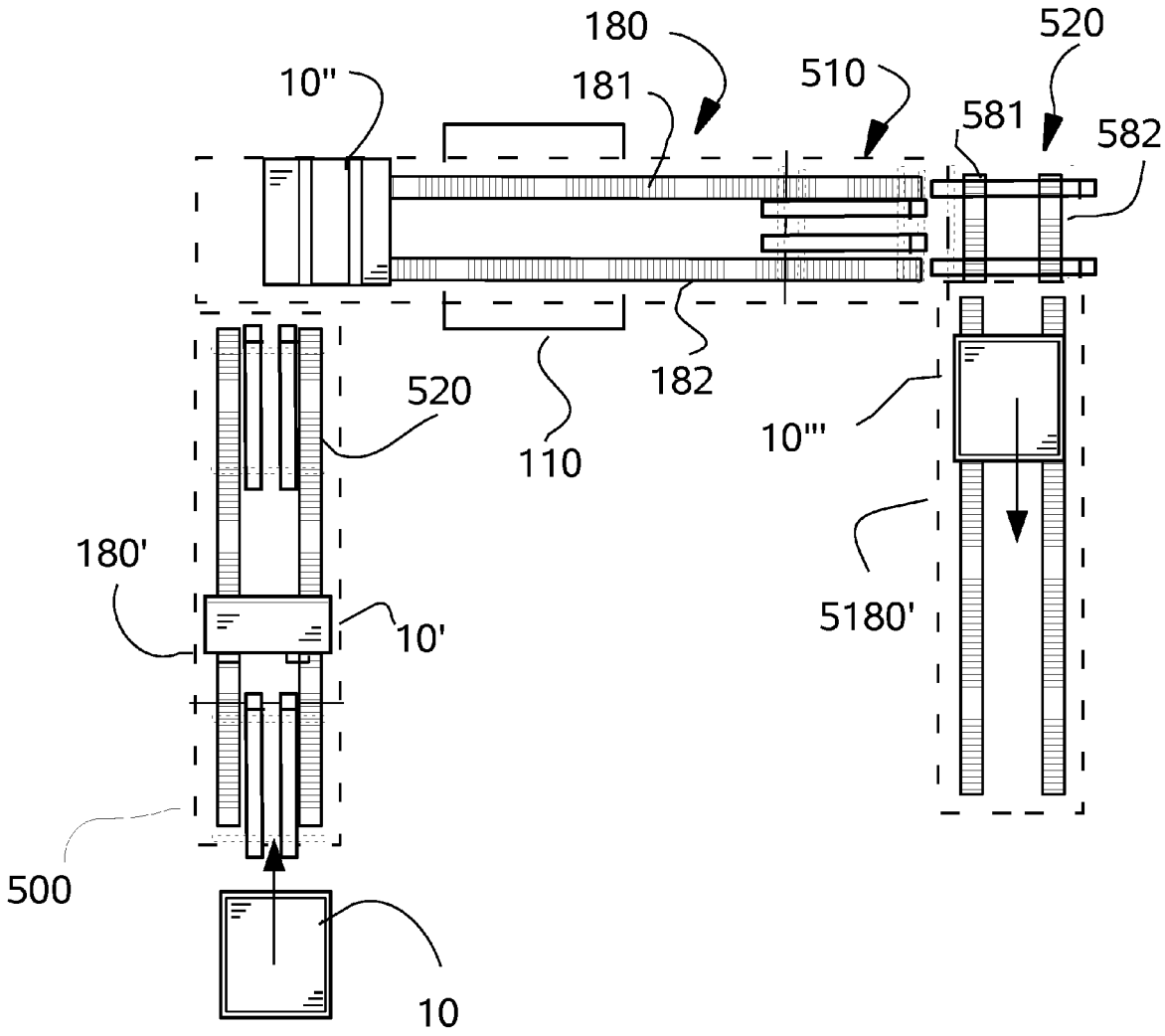
FIG. 5 is a plan view of washing station and conveyor system having additional entrance and exit conveys including means for rotating the fruit bins.
Figure 6A:
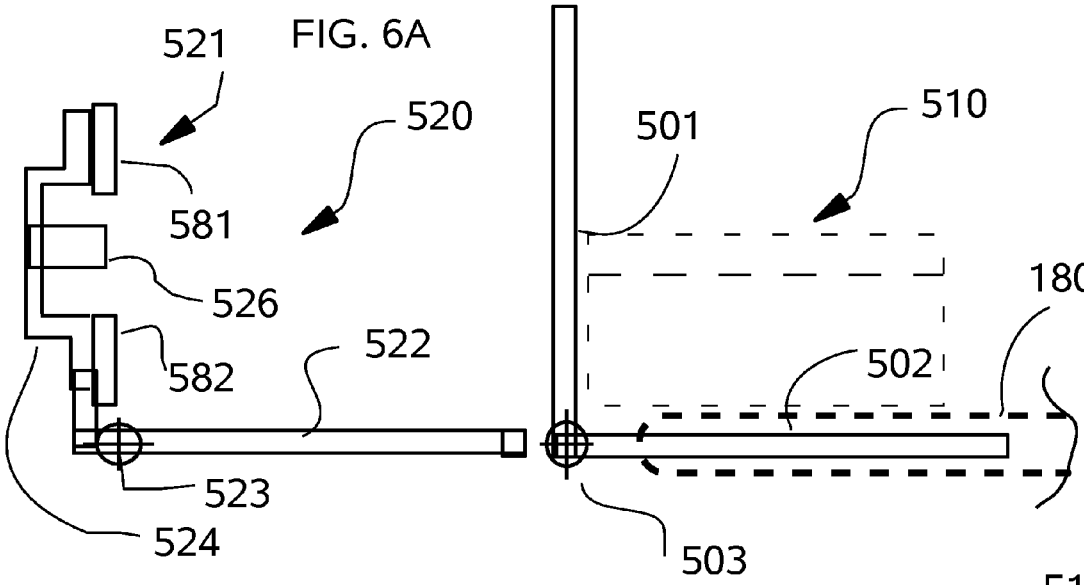
FIG. 6A is a side elevation of a first and second L-shaped pivoting arm optionally deployed at the exit to the conveyor.
Figure 6B:
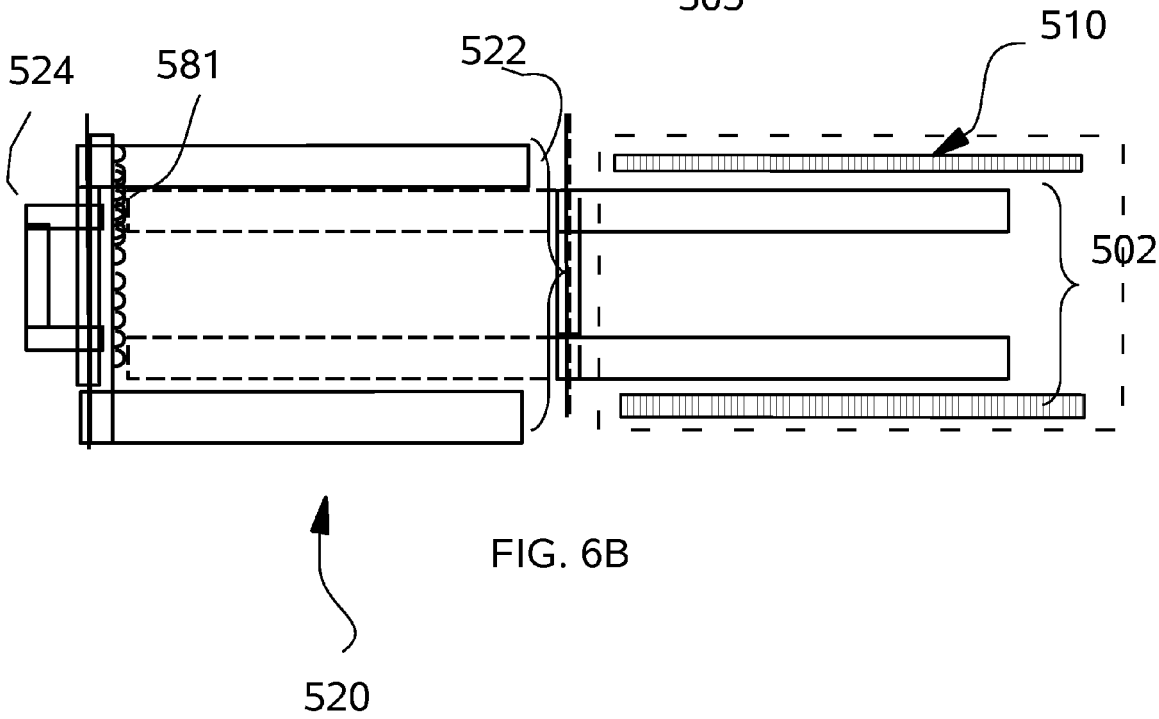
FIG. 6B is a plan view of FIG. 6A.

A shown in FIG. 5, the bins 10 while optionally received in the upright position, are first flipped 90 degrees (bin 10') on loading to the entrance conveyor 180', and then to an inverted position (bin 10") before entry to the washing station 110 in the process of being transferred from the entry conveyer 180' to the central conveyor 180. Likewise, after washing, the inverted bins 10" are flipped 180 degrees to the upright position (bin 10''') on removal from the washing station on the central conveyor portion 180 as they are transported to the exit conveyor 5180". Alternatively, the bins 10 may be flipped 180 directly on the central conveyor 180 housing the washing station 110. It should be appreciated that an accumulating track can be deployed on placed of conveyor 5180', in which the track has free spinning rollers to support the bins, and the entrance of a new clean bin on the track then urges the other bins forward.

It is particularly preferable that the 180 degree flip of each bin 10 before and after washing is provided by the cooperative action of pair of L-shaped pivoting arms 510 and 520, each of which rotates the bins 10 by 90 degrees.

Figures 7A, 7B, 7C, 8A, 8B:
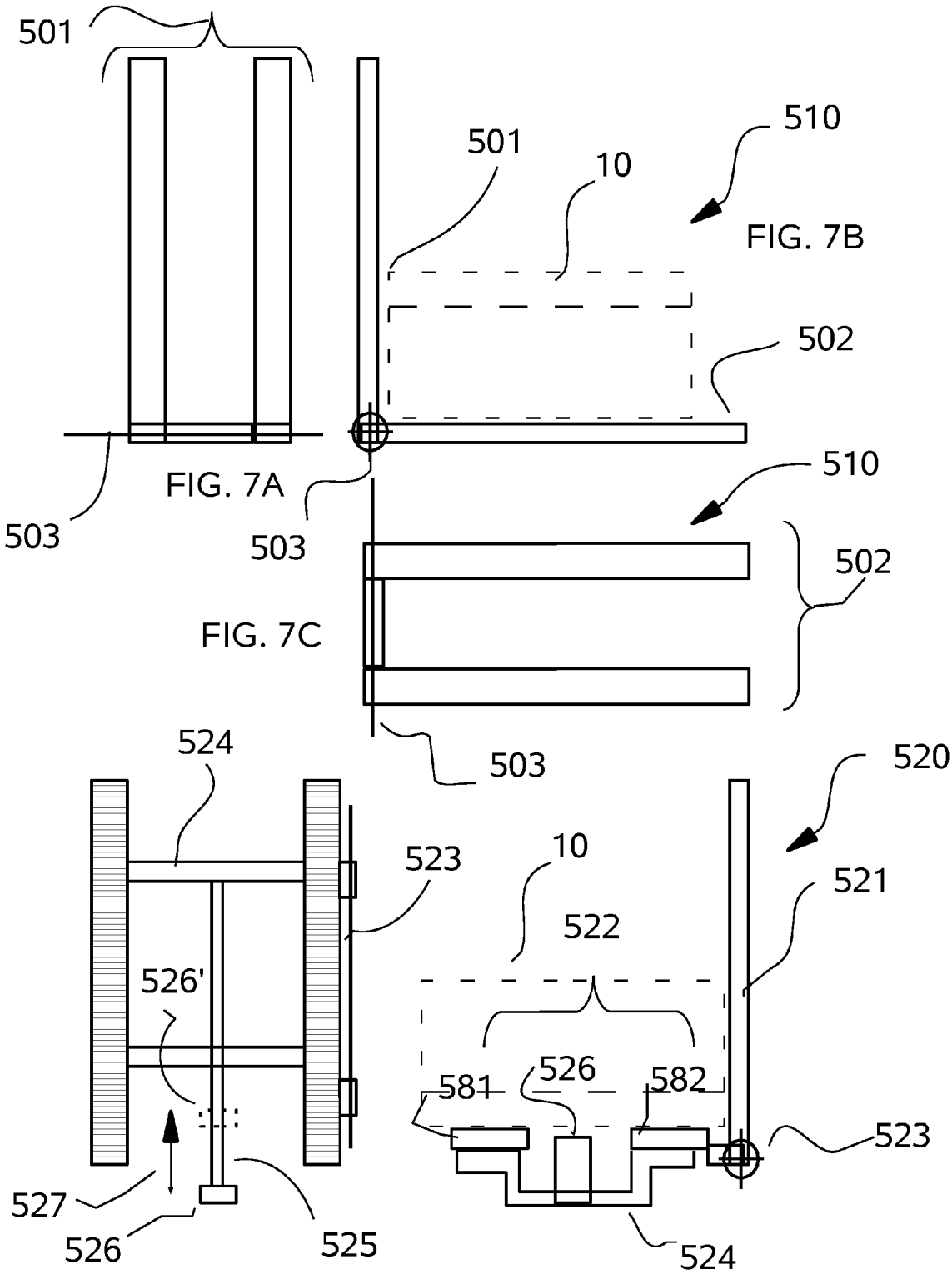
Figures 9A, 9B:
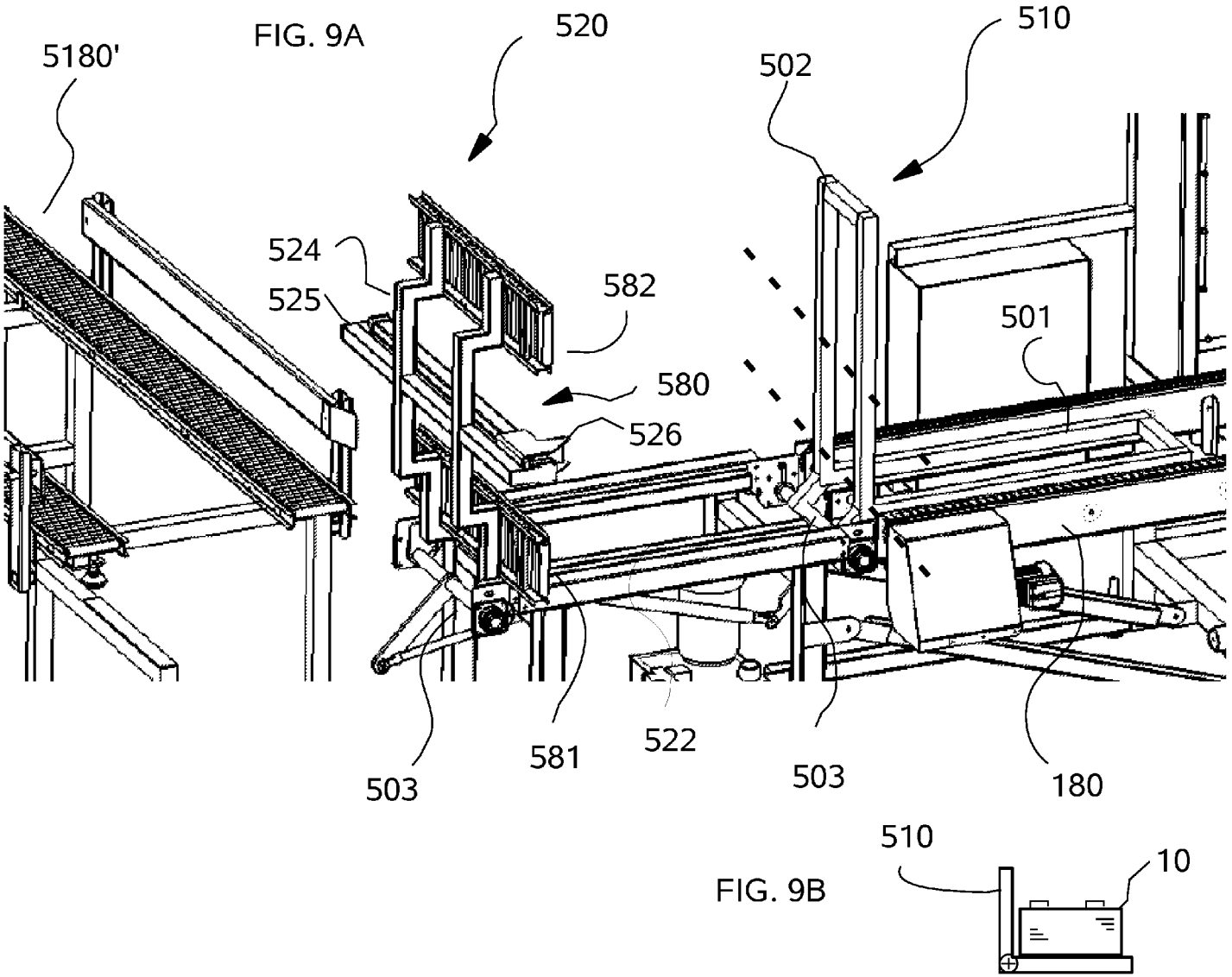

A particularly preferred aspect of such conveyance is illustrated in FIGS. 6 and 9-15. It should first be noted in FIG. 6 that the first L-shaped 510 is position to receive the bin 10 via the conveyor tracks 181 and 182. Hence, the vertical support section 501 or horizontal support section 502, while optionally solid or an open, is preferably pronged in a fork like manner to fit within the conveyer 180, between tracks 181 and 182. Further, on rotation of L-shaped pivoting arm 510 counter clockwise 90 degrees about axle 503, the present vertical support section 501 is configured to fit in nested engagement within the horizontal support section 522 of the second L-shaped pivoting arms 520. This orientation of L-shaped pivoting arm 520 after rotation is illustrated in FIGS. 8A and 8B. Thus, without further need for lateral conveyance of the bin, the further rotation of the second L-shaped pivoting arm 520 by 90 degrees in the counter clockwise direction (about axle 523) will complete the inversion of the bin 10, disposing in the vertical support section 521, which would then be substantially horizontally oriented.

In more preferred embodiments illustrated in FIG. 6-14, the L-shaped pivot arm 520, has a vertical or horizontal support portion that includes a means to convey the bin laterally after rotation of 90 degrees. Thus, as shown in FIGS. 7A and 7B, vertical support section 521 includes a pair of right 582 and left 581 roller tracks, which are support by a frame 523. In the particular embodiment of FIG. 8-13, the conveyance is accomplished by a pneumatically actuated push rod 526 with initiates the rolling movement of the bin over a series of free spinning rollers 581 and 582. A frame 524 also supports an actuator rod 525 that propels a push bar 526 that is coupled thereto. The actuator rod 525 drives the push bar 526 in the direction of arrow 527, so that when it is finally disposed at the phantom position 526' it will urge the bin 10 to roll on the roller tracks 581/582. As the vertical support section 521 preferably has as a support portion 522 consisting of the free spinning roller tracks, 581 and 582, is preferably pointed slightly downward so that the movement is assisted by gravity. The stroke of the push rod is about the width of the bin 10.

Further lateral conveyance of the bin 10 after this 90 degree rotation can be either in the direction of the rotation axis associated with the L-shaped pivoting arm, or transverse. Conveyance in the direction of the rotation axis is appropriate where the central conveyor portion 180 and the entrance 180' or exit conveyors 5180' are disposed at right angle as shown in FIG. 5. The contrary of the L-shaped pivoting arm 530 using roller 580 to conveyor the bin transverse to the rotation axle 530 of the L-shaped pivoting arm is shown in FIGS. 15A and 15B.

The sequence of the collaborative movement of L-shaped pivoting arm 510 and L-shaped pivoting arm 520 is depicted in more detail in FIG. 9A-14A, in which the bin is omitted for clarity. However, the bin orientation and position in illustrated in the inset labeled FIG. 9B-14B on the correspondingly numbered figure. Thus, FIG. 9A corresponds to the orientation of the L-shaped pivoting arms 510 and 520 shown in FIG. 7, but in a perspective view.

Figure 10A:
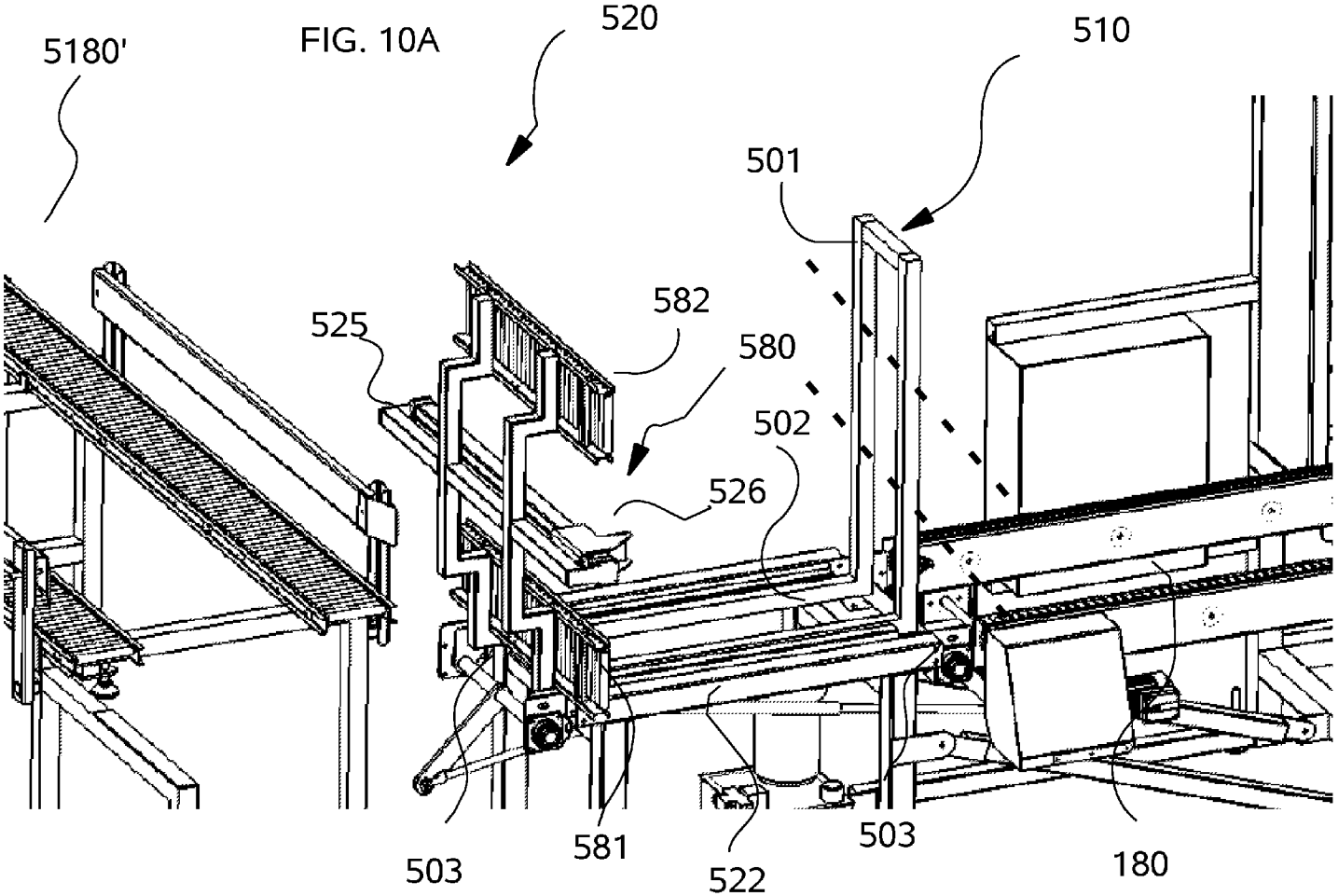
Figure 10B:
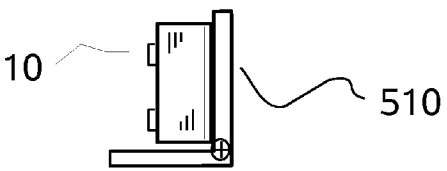
FIG. 10B is a schematic elevation view at a smaller scale showing the orientation of the bin during this stage.
Figure 11A:
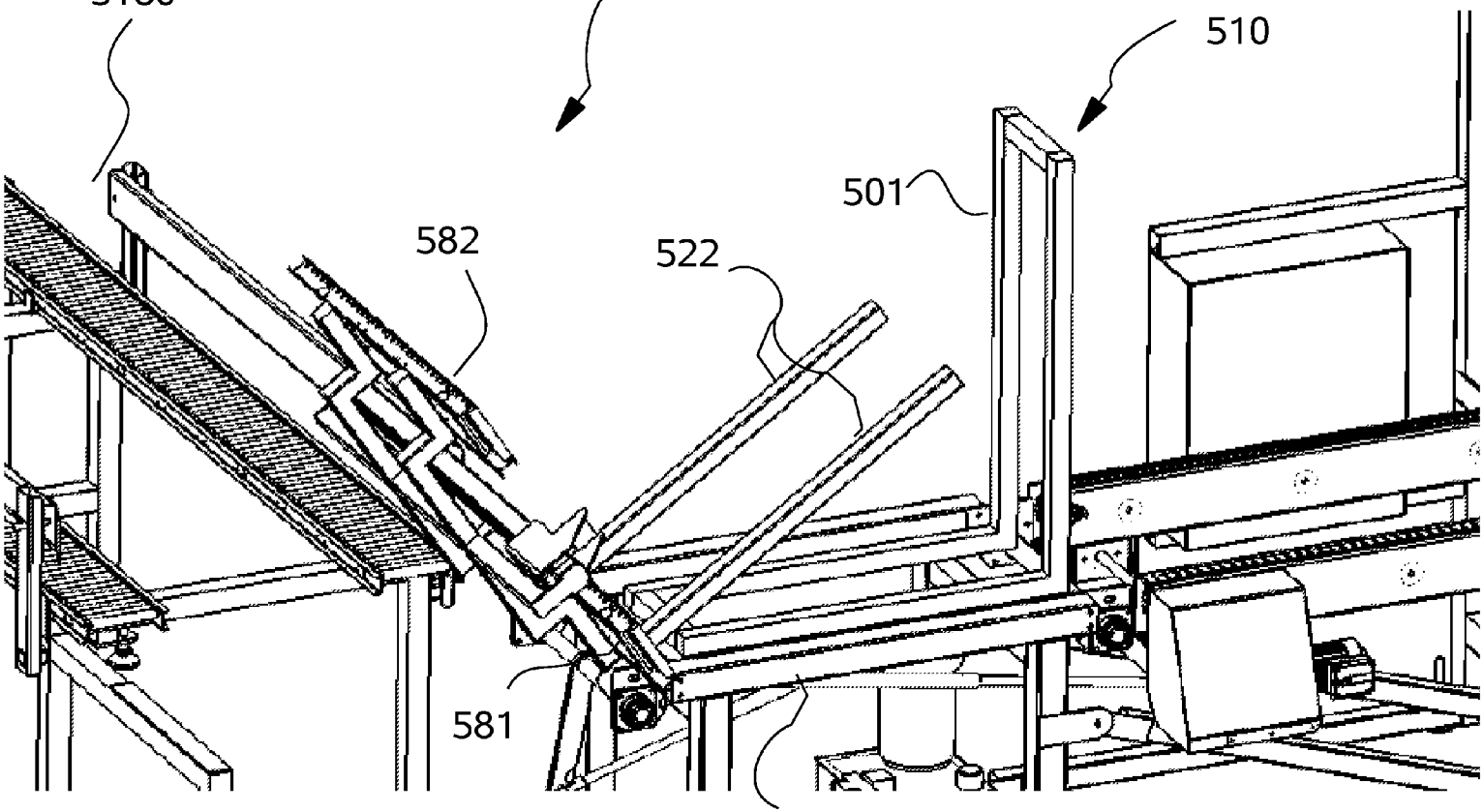
Figure 11B:
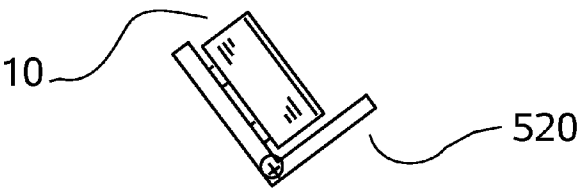
FIG. 11B is a schematic elevation view at a smaller scale showing the orientation of the bin upon completing this stage.
Figure 12A:
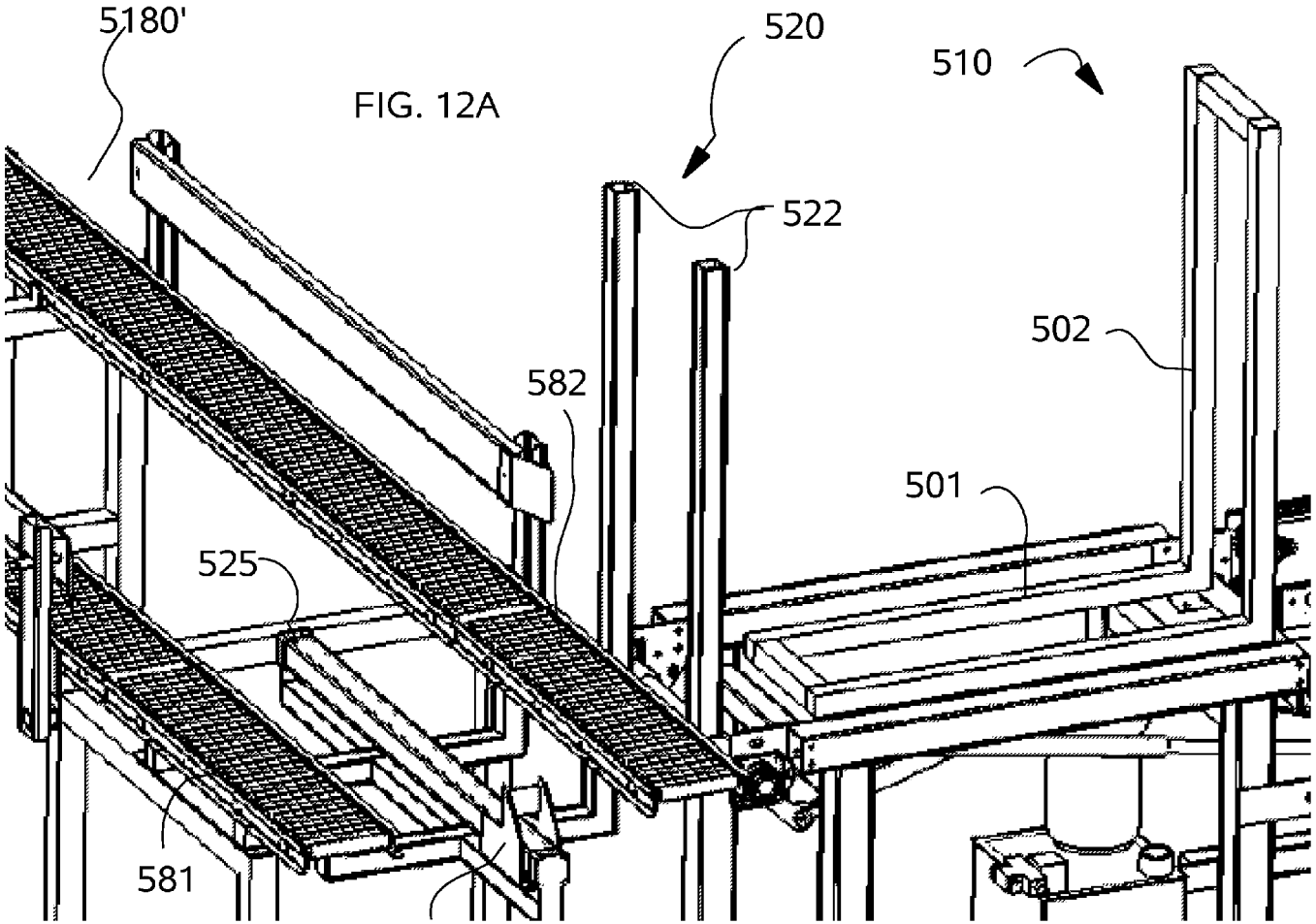
Figure 12B:
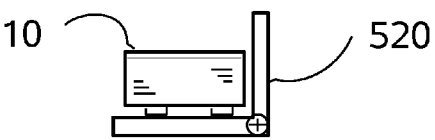
FIG. 12B is a schematic elevation view at a smaller scale showing the orientation of the bin during this stage.
Figure 13:
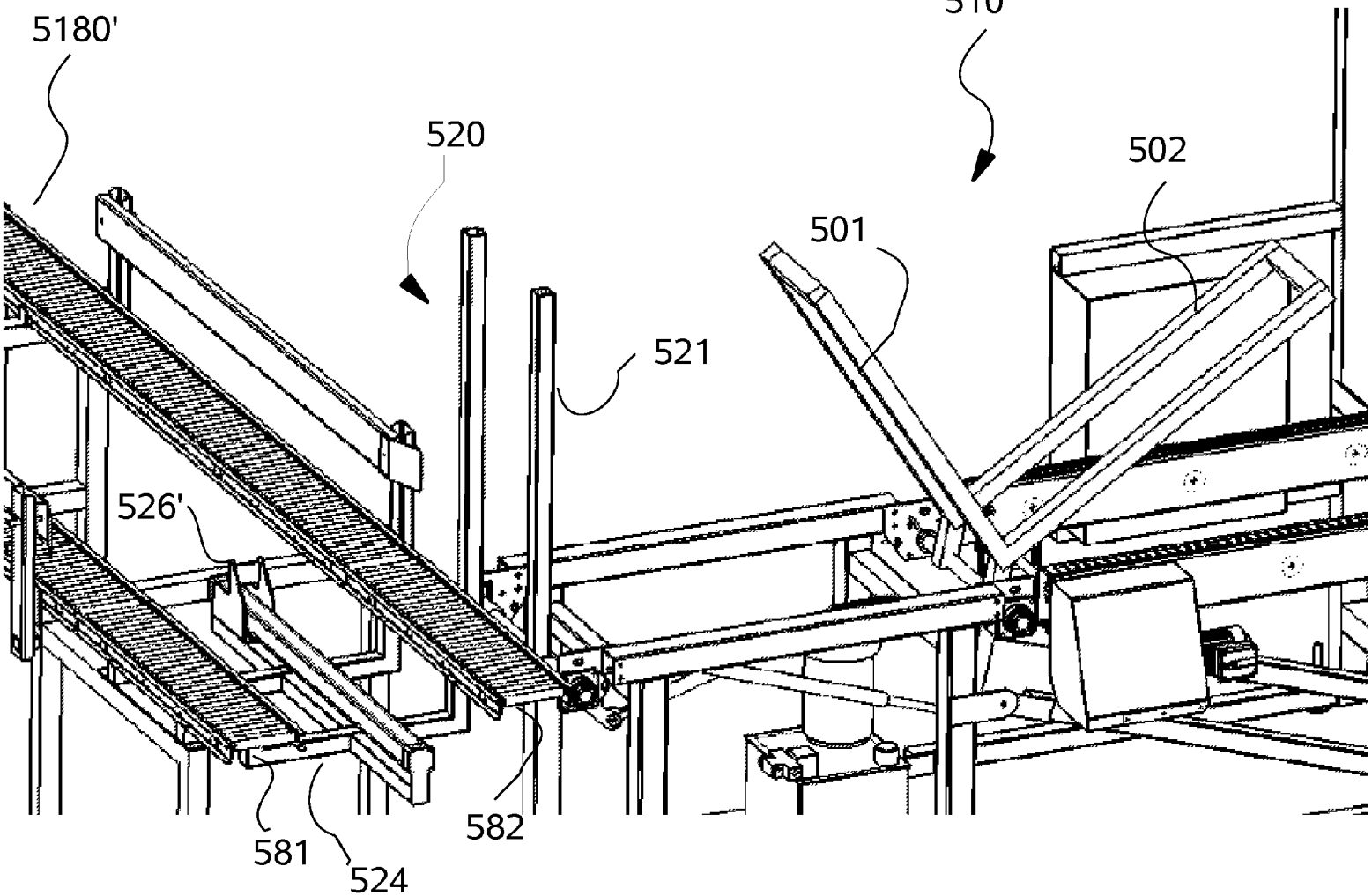
Figure 14:
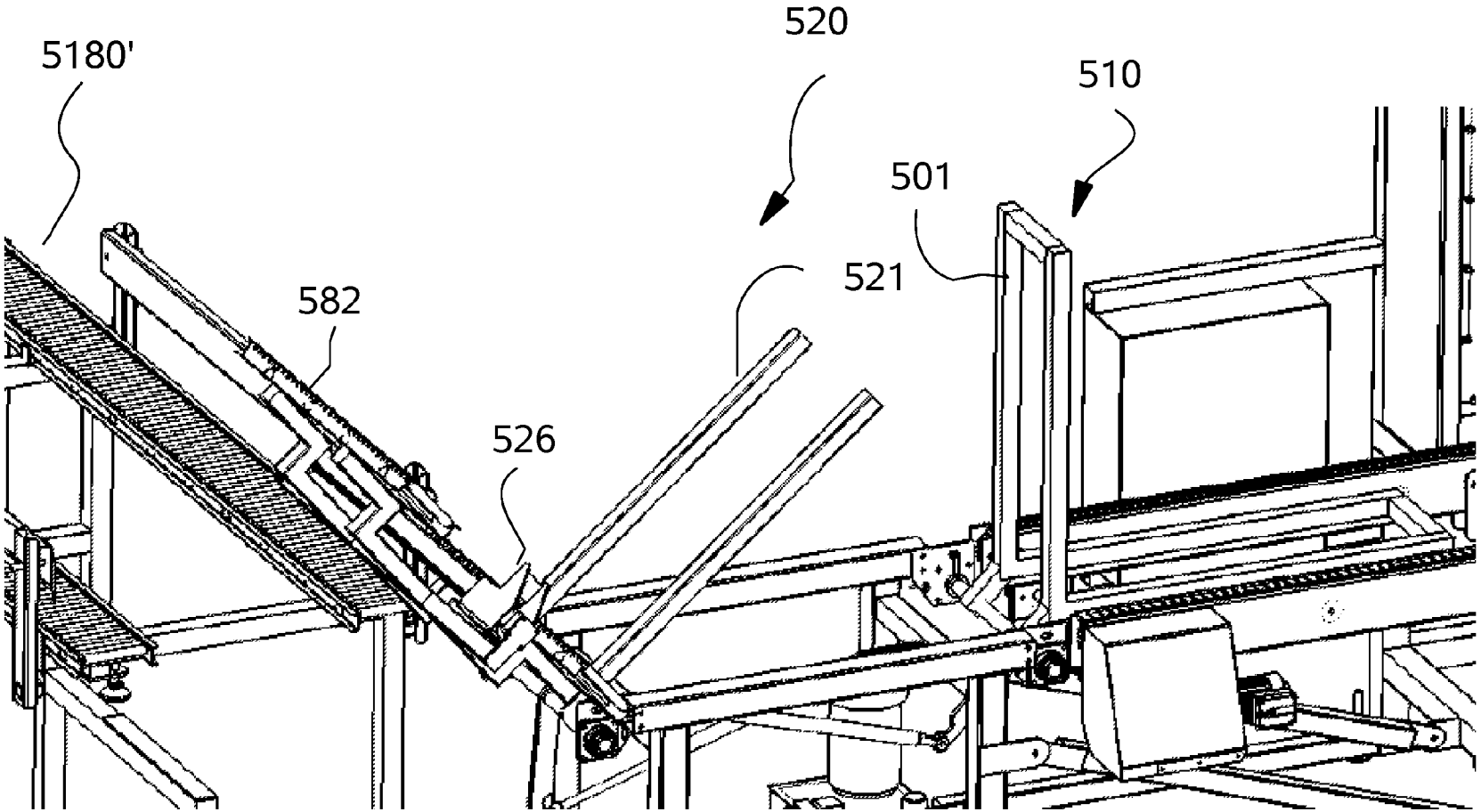

In FIG. 10, 510 is rotated 90 degrees counter clockwise to position bin 10 onto horizontal support section 521 of L-shaped pivoting arm 520. FIG. 11A shows the process of L-shaped pivoting arm 520 rotating 90 degrees counter-clockwise, in which it has rotated about 45 degrees. FIG. 12 the completion of the 90 degree rotation of L-shaped pivoting arm 520. FIG. 13 shows the process of L-shaped pivoting arm 520 returning to the position in FIG., in which it has rotated about 45 of 90 degrees clockwise. FIG. 14 shows the process of L-shaped pivoting arm 510 returning to the position in FIG., in which it has rotated about 45 of 90 degrees clockwise.

Figure 15A:
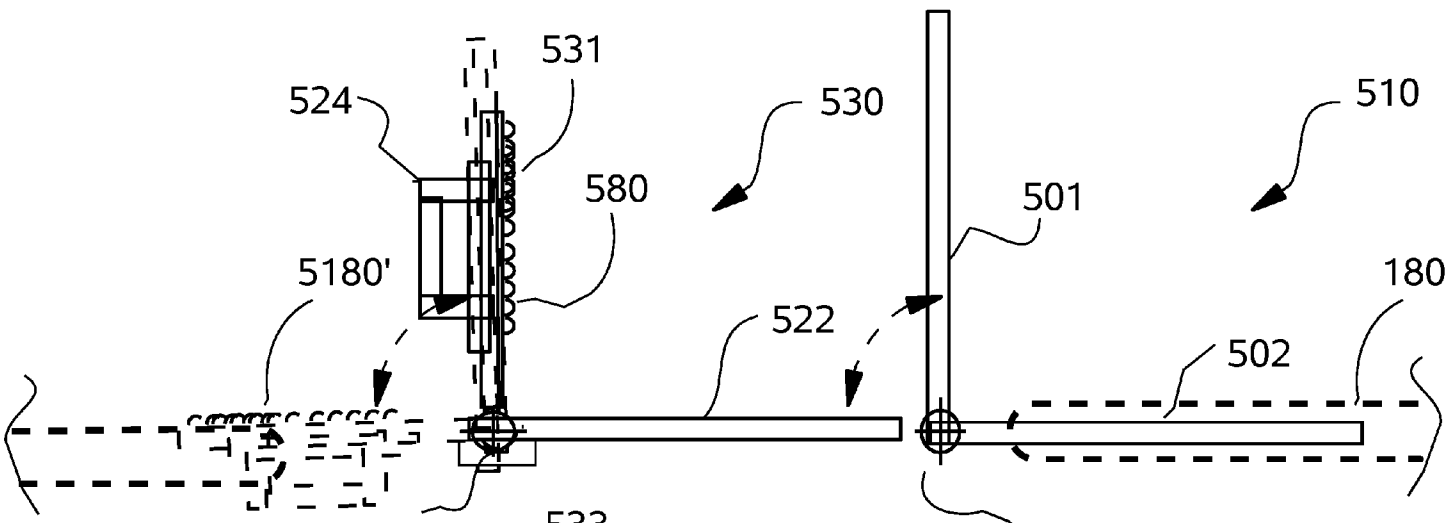
FIG. 15A is a side elevation of a first and second L-shaped pivoting arm optionally deployed at the exit to the conveyor.
Figure 15B:
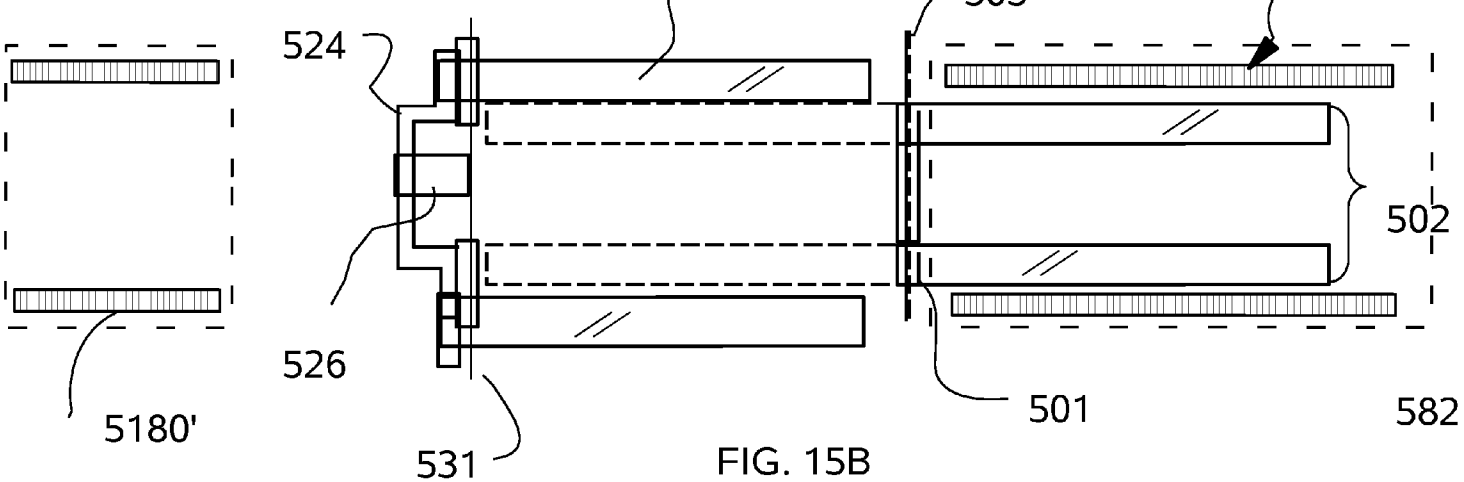
FIG. 15B is a plan view of FIG. 6A.

FIGS. 15A and 15B illustrate an alternative embodiment in which either single or multiple roller tracks or conveyor 580 is disposed vertical support surface 531 on L-shaped pivoting arm 530 to urge bin 10 onto the accumulator track 5180' that is oriented to convey sequential bins in the same direction as they are transported on conveyor system 180 having washing station 110.

It should be appreciated that alternative conveyance means to the push rod 526 and roller combination 581/582 of FIG. 7-15 is powered belt, linked plates, chain drive(s) and the like.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

We claim:

1. An apparatus for washing fruit bins, the apparatus comprising:

a) a first means to simultaneously rinses the 4 inside walls, the top and a first pair of opposing exterior sides of an inverted stationary bin, the inverted bin having the open side facing downward, the top being opposite the open side that faces downward, the bin having a second pair of opposing exterior sides disposed orthogonally to the first pair thereof and;

b) a second means to rinse the second pair of opposing exterior sides as the bin is transported in and out of the stationary position used to wash the inside and top.

2. An apparatus for washing fruit bins according to claim 1 that further comprise a means for inverting fruit bins from an upright to an inverted before the first and second rinsing means and a means for inverting fruit bins from an inverted to an upright position after the first and second rinsing means.

3. An apparatus for washing fruit bins according to claim 1 that further comprises a conveyor means that is a U-shaped conveyor track having terminal ends with the washing station is disposed in the center of the U between the terminal ends, and further comprising means to invert the bins on loaded and unloading from the terminal ends whereby the bins can be loaded and removed in an upright position.

4. An apparatus for washing fruit bins according to claim 1 that further comprises a means for collecting the water after it drains off fruit bins and means for filtering and ozonating the treated water passes through the particulate filter means.

5. A bin washing system comprising:

a) a conveyor track for transporting inverted bins laterally, b) a wash station surrounding a portion of said conveyor track, the conveyor track configured to deliver bins to the wash station from an inboard side thereof and dispense bins on an outboard side thereof, c) a first pair of upright spray bars disposed on opposite sides of the conveyor track on an inboard side of the wash station, d) a second pair of upright spray bar disposed on opposite sides of the conveyor track on an outboard side of the wash station, e) an overhead spray bar in the wash station configured to move transverse to the conveyor direction, f) an oscillating interior spray bar capable of extending upward from below the conveyor track in the wash station, and a a third pair of upright spray bars that are coupled to move transverse to the conveyor direction in the wash station with the overhead spray bar, each spray bar of the third pair being disposed on opposite sides of the wash station for spraying water toward the center of the wash station when an inverted bin resides therein.

6. A bin washing system according to claim 5 that further comprises a means for collecting rinse water from below the wash station.

7. A bin washing system according to claim 6 that further comprises a means for filtering particulate from water collected from below the wash station.

8. A bin washing system according to claim 6 that further comprises a means for ozonating water collected from below the wash station after the filtering of particulate and further comprising a means to recycle the filtered and ozonated water for a first rinse of bins that enter the apparatus.

9. A bin washing system according to claim 8 that further comprises a means to use fresh water for a second rinse of bins within or exciting the wash station after the first rinse with ozonated re-cycled water.

10. A bin washing system according to claim 8 wherein the means for ozonating the rinse water is the supply of ozone rinse to the tank that collects the rinse water.

11. An apparatus for cleaning fruit bins, which comprises:

a) a washing station having;

i) a means to simultaneously spray water on all of an interior, a top exterior surface and at least two exterior outside surfaces of a stationary inverted fruit bin, ii) a means to collect the water that drains off the stationary fruit bin in the washing station, and iii) a means to filter particulate from the collected water, b) a conveyor means that is operative to;

i) receive upright fruit bins and invert the upright fruit bins before conveying them to the washing station, ii) convey inverted fruit bins from the washing station and then invert the bins to an upright position for subsequent removal from the conveyor means.

12. An apparatus for cleaning fruit bins according to claim 11 wherein the means for simultaneously spraying water on the inside surface of the stationary inverted fruit bin comprises an oscillating interior spray bar capable of extending upward from below the conveyor means in the wash station.

13. An apparatus for cleaning fruit bins according to claim 11 wherein the conveyor means is a U-shaped conveyor track having terminal ends with the washing station is disposed in the center of the U between the terminal ends, and further comprising means to invert the bins on loaded and unloading from the terminal ends whereby the bins can be loaded and removed in an upright position.

14. An apparatus for washing fruit bins according to claim 12 wherein the oscillating interior spray bar has at least one of a has D or U shape and a series of nozzles arranged along the length thereof, wherein each nozzle provides a fan shaped spray patterns within the plane of the D or U shape of the spray bar for reaching the interior of a rectangular bin placed in the washing station during such oscillation.

15. An apparatus for cleaning fruit bins according to claim 11 that further comprises a means to invert a fruit bin by two sequential rotations of about 90 degrees.

16. An apparatus for cleaning fruit bins according to claim 15 wherein the apparatus has an L-shaped pivoting arm for each 90 degree rotation.

17. An apparatus for cleaning fruit bins according to claim 15 wherein the means to invert a fruit bin comprises at least one pair of a first and second L-shaped pivoting arm, wherein the first L-shaped pivoting arm is operative to transport a fruit bin directly to the second L-shaped pivoting upon rotated the fruit bin by 90 degrees.

18. An apparatus for cleaning fruit bins according to claim 11 that further comprises a transporting pivoting means after the wash station, and an accumulating track after the transporting pivoting means, wherein the transporting pivoting means is a pair of a first and second pair L-shaped pivoting arms, in which the first pivoting arm is operative to rotate a fruit bin 90 degrees into a position to be directly received by the second pivoting arm, wherein the second pivoting arm is operative to rotate a fruit bin 90 degrees.

19. An apparatus for cleaning fruit bins according to claim 18 wherein the second L-shaped pivoting arm comprises:

i) a sequential plurality of substantially adjacent free spinning rollers that form a side of the L-shape, and ii) a push bar operative to propel a fruit bin on the rollers wherein rollers are disposed at a descending angle from the horizontal plane whereby gravity is sufficient to continue the transport of the fruit bin down the free spinning rollers after the movement thereon is initiated by the push bar.

* * * * *